US006257994B1

(12) United States Patent
Antonious

(10) Patent No.: US 6,257,994 B1
(45) Date of Patent: Jul. 10, 2001

(54) BALL STRIKING FACE CONFIGURATIONS FOR GOLF PUTTERS

(76) Inventor: Anthony J. Antonious, 7738 Calle Facil, Sarasota, FL (US) 34238

( * ) Notice: Subject to any disclaimer, the term of this patent is extended or adjusted under 35 U.S.C. 154(b) by 0 days.

(21) Appl. No.: 09/534,049

(22) Filed: Mar. 24, 2000

(51) Int. Cl.[7] ..... A63B 53/04
(52) U.S. Cl. ..... 473/331; 473/340
(58) Field of Search ..... 473/324, 330, 473/331, 329, 342, 340; D21/736, 742, 743, 744, 750, 751

(56) References Cited

U.S. PATENT DOCUMENTS

D. 63,284 * 11/1923 Challis .
D. 138,380 * 7/1944 Myers .
722,927 * 3/1903 Swift .
1,094,599 * 4/1914 Samson .
1,503,291 * 7/1924 Rimmer .
4,529,203 * 7/1985 Ribaudo .
5,354,059 * 10/1994 Stuff .
6,007,434 * 12/1999 Baker .
6,089,993 * 7/2000 Woodward .
6,110,057 * 8/2000 McKinnon .

FOREIGN PATENT DOCUMENTS

21871 * 11/1892 (GB) ..... 273/167 J

* cited by examiner

*Primary Examiner*—Sebastiano Passaniti
(74) *Attorney, Agent, or Firm*—Welsh & Flaxman LLC

(57) ABSTRACT

A putter type golf club head having a variety of ball striking face configurations including free standing, raised projections, punch marks, vertical and horizontal grooves and combinations thereof.

5 Claims, 4 Drawing Sheets

FIG. 1
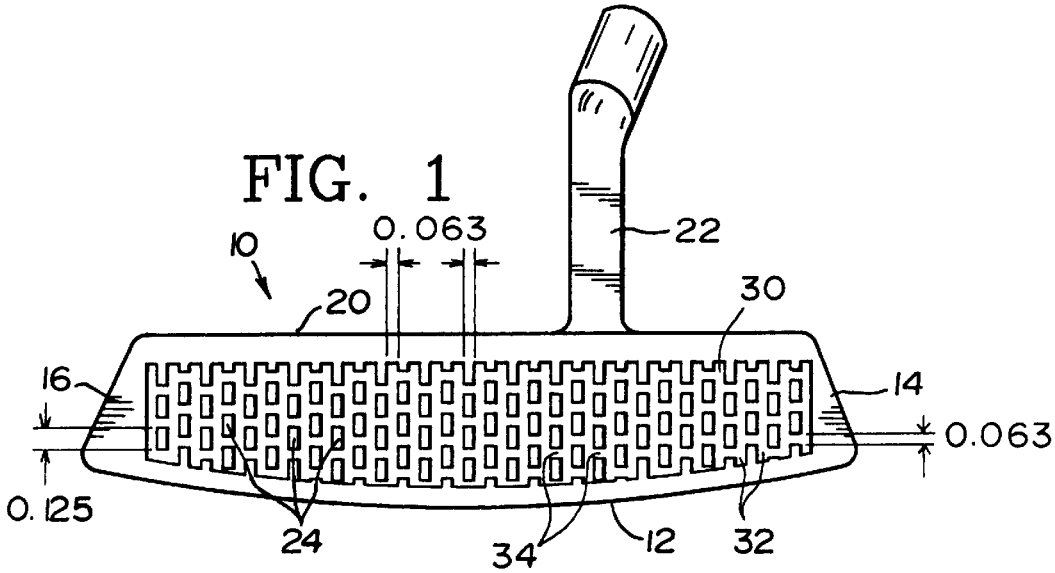
FIG. 2
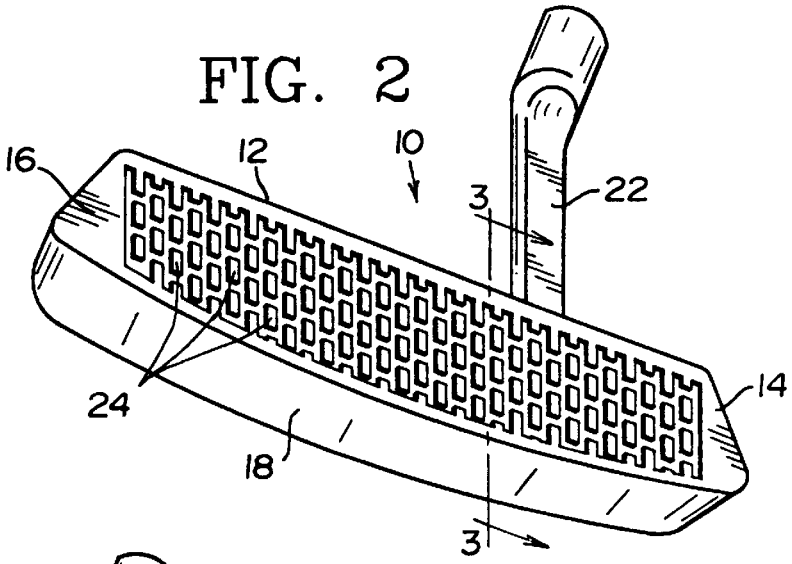
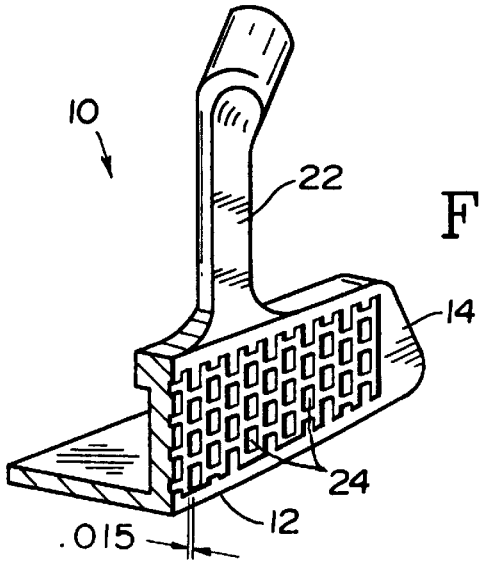
FIG. 3

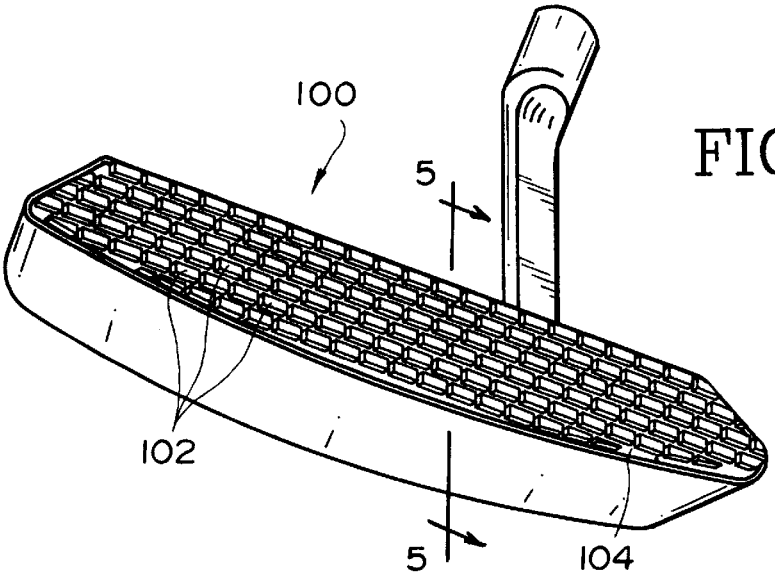
FIG.4
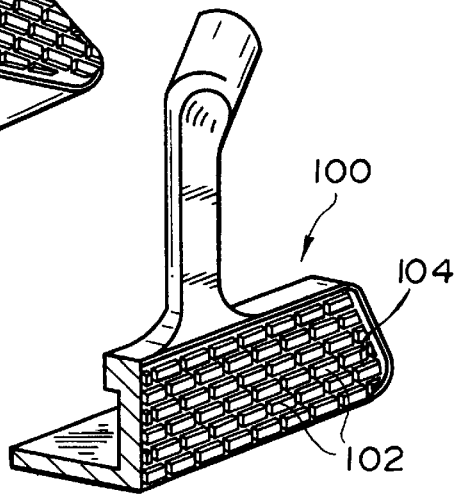
FIG.5
FIG.6
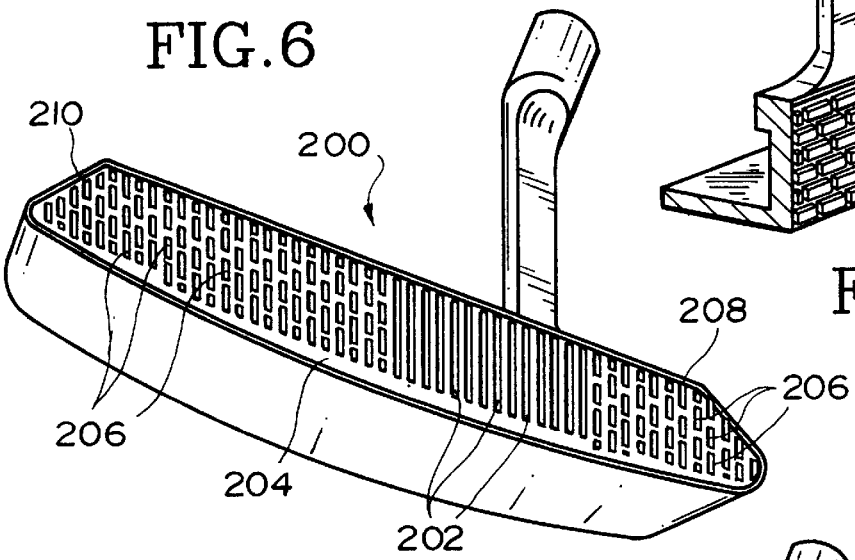
FIG.7
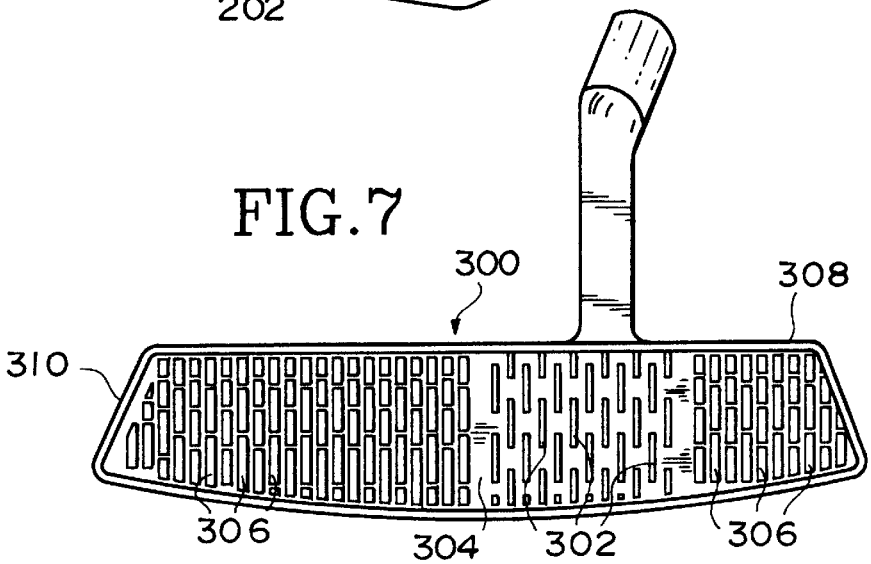

BALL STRIKING FACE CONFIGURATIONS FOR GOLF PUTTERS

BACKGROUND OF THE INVENTION

The present invention relates to golf putters and in particular to putters with improved ball striking face configurations.

It is well known that a golf ball tends to skid a considerable distance across a putting green surface after being struck by a planar ball striking face of a putter before it begins to roll. Various ball striking face surfaces, many with face insets made of different materials, have been developed to improve the way a golf ball rolls off a putter face.

For example U.S. Pat. No. 5,709,616 to Rife uses a series of horizontal, V-shaped grooves with truncated outer ball gripping edges to grip a golf ball as it leaves the striking face to increase roll.

U.S. Pat. No. 5,637,044 to Swash shows a golf putter having a ball striking face with a plurality of concentric grooves.

U.S. Pat. No. 4,964,641 to Miesch et al. shows a putter face made of an array of pyramids to increase friction between the golf ball and the putter face.

U.S. Design Pat. D 411,275 to Bottema et al. shows a putter face with an array of cylindrical projections.

U.S. Design Pat. D 415,809 to Bottema et al. shows a putter face with an array of cubed shaped projections.

U.S. Design Pat. D 57,980 to Kraeuter shows a putter face with an array of diamond shaped projections.

U.S. Pat. No. 6,007,434 to Baker et al. shows a putter face with an array of truncated, pyramid shaped projections.

U.S. Pat. Nos. 4,530,052 to Stuff et al. and 4,508,342 to Drake both show putter faces with vertical grooves.

U.S. Design Pat. D 63,284 to Challis shows a putter face with an array of square projections.

SUMMARY OF THE INVENTION

The present invention relates to a variety of putter ball striking face configurations including free standing raised projections, punch marks, vertical and horizontal grooves and combinations thereof.

The ball striking face surfaces of the present invention, in addition to producing substantially more cushioning effect at impact, also provide increased traction between the club face and the golf ball, resulting in optimum tracking accuracy from the initial ball contact and greater increased resistance to adverse lateral movements or reactions which can occur when off center ball contact occurs. Thus when a golf ball is struck by the ball striking face configurations of the present invention, there is a greater ball resistance to such things as minor surface imperfections on the putting green, and other impediments such as top dressing, grass cuttings or other particles sometimes found on putting green surfaces. Because of the increased top traction applied to golf balls when they are struck by the free standing, projections of this invention, the behavior of the balls is altered considerably. The balls begin to roll immediately with additional traction and axis spin resulting in the ball rolling over obstacles instead of being easily deflected. Furthermore, the raised projection designs of the present invention produce enhanced, positive traction between the club face and the golf ball whereby the ball quickly reacts and adheres to the club face for a slightly longer time than it would with a normal flat ball striking surface of conventional type putter faces. The tendency for the ball not to jump off of the club face is particularly useful in putting downhill putts or on extremely fast greens where controlling the ball speed is of primary importance.

The staggered free standing, rectangular projection designs of the present invention create more isolated land areas where ball contact occurs. This improved structure not only produces dramatically more cushion but permits the optimum transfer of energy to the precise point of ball contact on the putter face. Because less area of the ball is contacted by the smaller isolated, free standing land areas, the transmitted energy is more focused directly to the precise ball surface contact point rather than being dissipated across a larger planar striking face surface like that of traditional putter faces.

Applicant significantly associates his present invention, to the occurrence of one of Natures' phenomena involving the Laws of Physics and Dynamics. He has relied on the irrefutable visible results that occur, repeatedly, when a golf ball lands in a pond or any pool of water.

"Ripples" or "Concentric Rings" start forming immediately from the force at impact. Most notably, the available energy is distributed in a 360° direction, perpetuating a group of continuing "Concentric Rings", that behave in a most extraordinary manner . . . the "Concentric Rings" are symmetrically formed, retain their same space between them, and never overtake one another. Also, as the force or energy level diminishes, it does so equally, in a 360° direction. This amazing visual demonstration occurs each time, in the same order, at the same tempo and with the same results.

Using this knowledge, the present invention incorporates free standing, smaller rectangular projections on the ball striking face which are totally isolated, individually separated from each other. The free standing projections have planar land surface areas which permit only minimal contact of the putter face to a golf ball during a putting stroke thus concentrating the force at the precise point of contact between the ball and the club face. This minimizes any diminishing effect or energy loss of the impact force which can dissipate away from the golf ball, thereby allowing more energy to be instantly available for transmission directly to the ball at the precise point of contact on the putter face.

Further, the unusual concepts of this invention not only increase the ball's tracking accuracy and responsiveness, they also produce a significant and impressive amount of a "softer"-type built-in cushioning. The land area surfaces of the raised free-standing projections are much smaller than the land areas between the longer vertical or horizontal grooves . . . or the planar surfaces of conventional putter faces. Consequently, more energy is transmitted to the ball by the larger land areas of such putters. However, the free-standing construction of the smaller surfaces of this invention, appear to produce more P.S.I. available at ball-contact, than the larger land areas of other planar face or grooved putter faces.

Having this unique capability, putter faces with this invention permit golfers to stroke their putts, with more authority, knowing that the ball will not roll excessively beyond the intended hole. Also, golfers, knowing their balls will not roll and roll, uncontrollably far beyond their intended putting hole, quickly develop increased confidence and assurance when confronting fast downhill putts.

Quite often, some putts with visible "breaks" require the ball to be stroked on a "curved" path to have any chance of rolling into the intended cup. All golfers dread this situation.

However, the gripping action of this invention, is so effective and compelling that golfers can boldly stroke their balls, more directly to the hole, or with much less allowance for the normal "break" needed with putters having planar faces.

A first embodiment uses a series of free standing, raised rectangular projections which are offset with each adjacent projection in a vertical brick configuration.

A second embodiment uses a series of free standing, raised rectangular projections which are staggered in a horizontal, brick configuration.

A third embodiment uses a series of free standing, vertical raised projections at the center of the club face and a series of raised rectangular projections which are staggered in a vertical brick configuration at the heel and toe sections of the putter face.

A fourth embodiment uses a series of spaced, hyphenated, vertical raised projections at the center of the club face and a series of free standing, raised rectangular projections which are staggered in a vertical brick configuration at the heel and toe sections of the putter face.

A fifth embodiment uses an array of free standing, three sided, equilateral triangular shaped, raised projections on the ball striking face.

A sixth embodiment uses a series of vertical, hyphenated grooves.

A seventh embodiment uses a series of full length vertical grooves centrally located on the club face and an array of punch marks at the heel and toe.

An eighth embodiment uses an array of punch marks centrally located on the club face in a series of full length vertical grooves at the heel and toe.

Among the objects of the present invention are the provision of an improved ball striking face configuration for golf putters that effectively transfers more productive energy directly to a golf ball from the initial ball contact allowing it to roll with a more positive and accurate directional control.

Another object is the provision of a golf putter having a ball striking surface which enhances a golfers ability to stroke putted balls with more authority to provide better distance control and accurate direction of a stroked golf ball.

Other objects, advantages and salient features of the invention will become apparent from the following detailed description, which taken in conjunction with the annexed drawings, discloses a preferred, but non-limiting, embodiment of the subject invention.

BRIEF DESCRIPTION OF THE DRAWINGS

FIG. 1 shows a front elevational view of a first embodiment of a putter face configuration in accordance with the present invention.

FIG. 2 is a front perspective view of the embodiment of FIG. 1.

FIG. 3 is a sectional perspective view taken along the lines 3—3 of FIG. 2.

FIG. 4 is a perspective view of a second embodiment in accordance with the present invention.

FIG. 5 is a sectional view taken along the lines 5—5 of FIG. 4.

FIG. 6 is a perspective of a third embodiment in accordance with the present invention.

FIG. 7 is a front elevational view of a fourth embodiment in accordance with the present invention.

DESCRIPTION OF THE PREFERRED EMBODIMENTS

Figure 8:
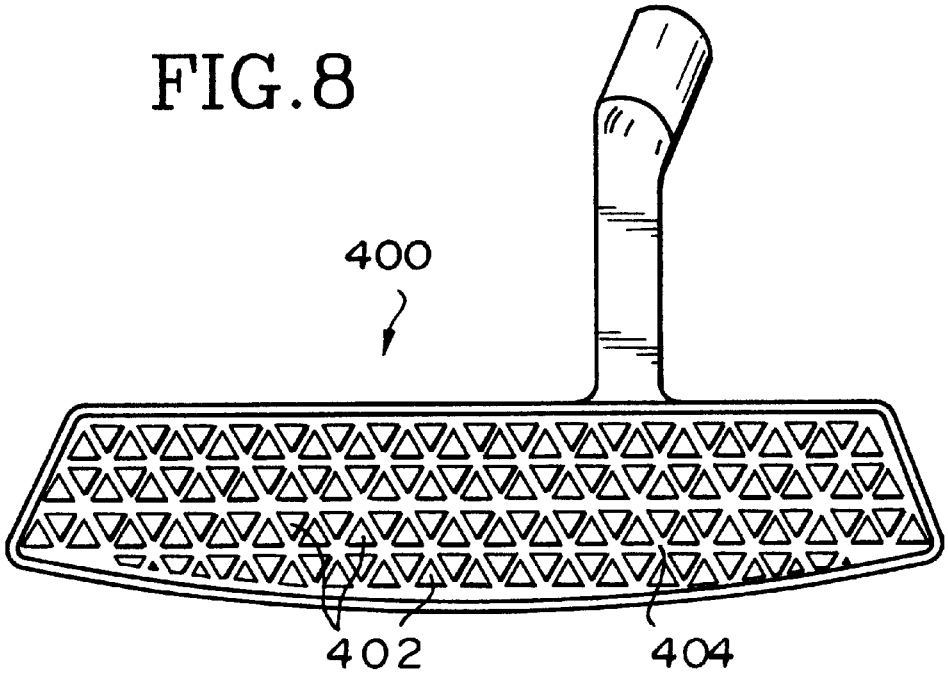
FIG. 8 is a front elevational view of a fifth embodiment in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1 to 3 illustrate a standard golf putter 10 including a ball striking face 12, a heel 14, a toe 16, bottom surface 18, top edge 20, and hosel 22 for connection to a shaft, not shown. The ball striking face 12 is formed with a series of vertically oriented, free standing, raised rectangular projections 24. The projections 24 are staggered row to row and form a brick type configuration, whereby the centers of one row of projections 24 are directly opposite the ends of projections 24 of an adjacent row.

Each projection has vertical parallel sides 26 and parallel horizontal ends 28. The void area 30 between the projections 24 creates columns of spaces 32 between columns of projections 24 and spaces 34 between horizontal ends of the projections. The depth of the spaces 32 formed by the void area 30 is approximately 0.015 inches and does not exceed 0.017 inches. The dimensions of each projection 24 is preferably 0.125 inches in length, 0.063 inches in width and does not exceed 0.017 inches in height. The spaces 32, 34 are the same width as the width of the projections 24, that is 0.063 inches. Preferably, in accordance with the present invention, the width of the projections 24 is the same as the width of the spaces 32, 34. However, the length, width, and spacing between the projections may be varied.

FIGS. 4 and 5 show a second embodiment of a golf putter 100 having a series of horizontal rows of free standing, rectangular projections 102 on the ball striking face 104. The projections 102 are staggered row to row and form a brick type configuration, whereby the centers of one row of projections 102 are opposite ends of projections 102 of an adjacent row.

FIG. 6 shows a third embodiment of a golf putter 200 having a series of elongated, vertical projections 202 at the center of the club face 204 and a series of free standing, raised rectangular projections 206 which are staggered in a vertical brick configuration at the heel 208 and toe 210 sections of the putter face 204.

FIG. 7 shows a forth embodiment of a golf putter 300 using a series of spaced, hyphenated vertical raised projections 302 at the center of the club face 304 and a series of raised, free standing, rectangular projections 306 which are staggered in a vertical brick configuration at the heel 308 and toe 310 sections of the putter face 304.

Figure 12:
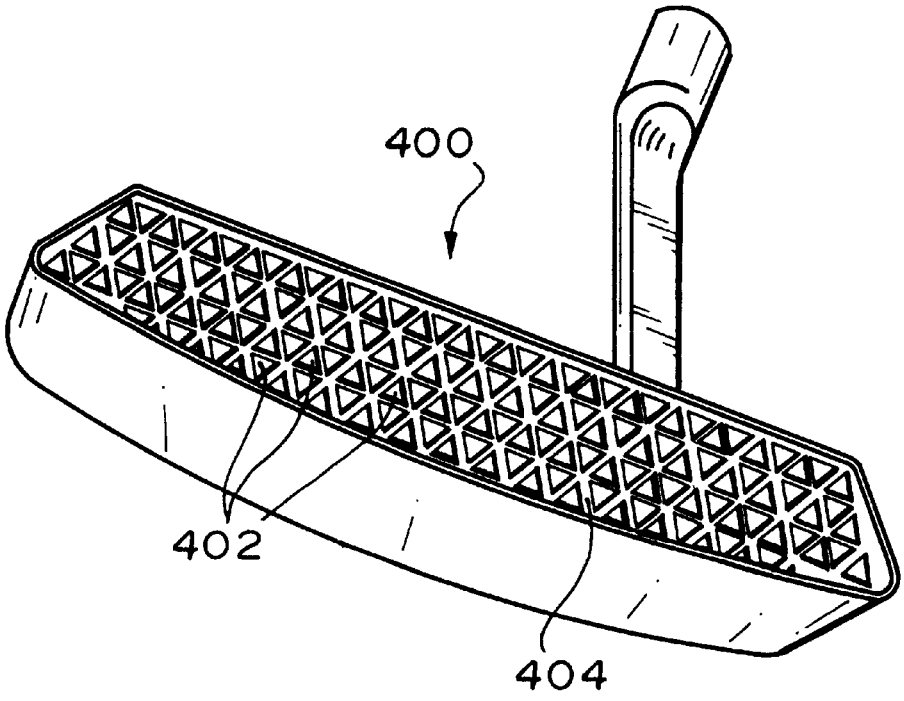
FIG. 12 is a perspective view of FIG. 8 in accordance with the present invention.

FIGS. 8 and 12 show a fifth embodiment of a golf putter 400 using an array of three sided equilateral triangular shaped, free standing, raised projections 402 on the ball striking face 404.

Figure 9:
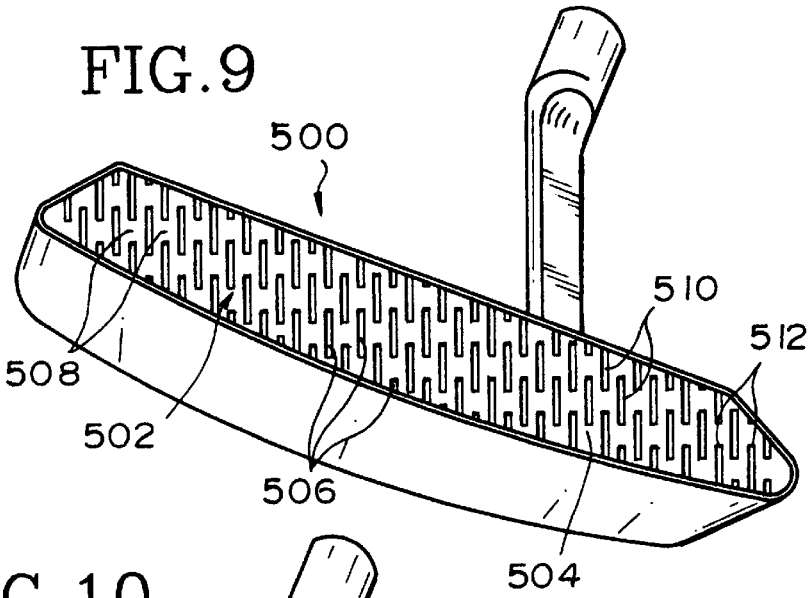
FIG. 9 is a perspective view of a sixth embodiment in accordance with the present invention.

FIG. 9 shows a sixth embodiment of a golf putter 500 using a vertical, hyphenated groove configuration 502 on the ball striking face 504. The hyphenated groove configuration 502 includes a series of individual lengths of grooves 506 vertically oriented across the ball striking face 504. The grooves 506 have vertical sides 510 and horizontal ends 512 which form gripping edges on the putter striking face 504. The individual lengths of grooves 506 are vertically spaced, in an end to end relationship, forming a gap 508, between the vertically adjacent individual lengths of grooves 506.

Figure 10:
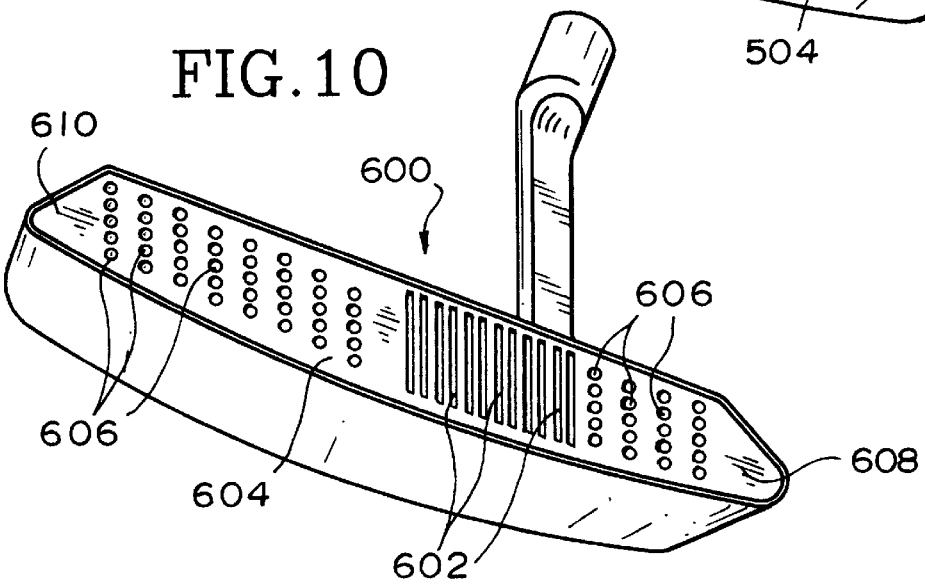
FIG. 10 is a perspective view of a seventh embodiment in accordance with the present invention.

FIG. 10 shows a seventh embodiment of a golf putter 600 using a series of full length vertical grooves 602 centrally located on the club face 604 and an array of punch marks 606 at the heel 608 and toe 610.

Figure 11:
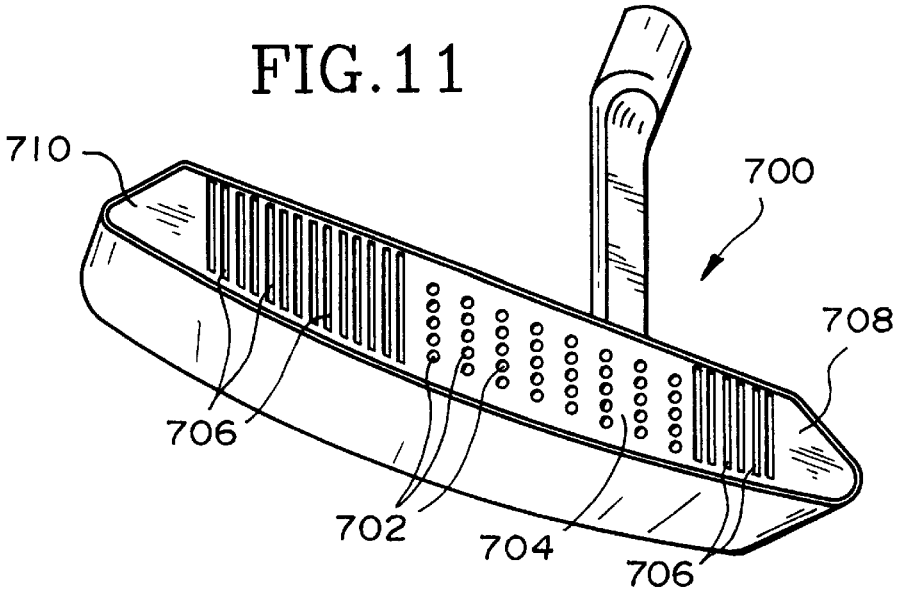
FIG. 11 is a perspective view of an eight embodiment in accordance with the present invention.

FIG. 11 shows an eighth embodiment of a golf putter 700 using an array of punch marks 702 centrally located on the club face 704 and a series of full length vertical grooves 706 at the heel 708 and toe 710.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A putter type golf club head including a ball striking face, heel, toe, upper surface and lower surface, wherein the improvement comprises: vertical columns of multiple raised, free standing, rectangular projections on said ball striking face between said upper surface and said lower surface; said free standing, rectangular projections forming a brick pattern whereby individual projections in any one column are staggered with respect to corresponding individual projections in adjacent columns; and, wherein ends of individual projections in one column of said free standing, rectangular projections are directly opposite centers of individual projections of said free standing, rectangular projections in adjacent columns.

2. The golf club head of claim 1 further including a second series of narrow elongated vertical projections on said club face.

3. The golf club head of claim 2 wherein said second series of narrow elongated vertical projections are hyphenated.

4. The golf club head of claim 1 wherein said rectangular projections are hyphenated forming a space between ends of aligned vertical projections.

5. The club head of claim 1 being further defined as a putter.

* * * * *